US007914257B1

(12) United States Patent
Liang

(10) Patent No.: US 7,914,257 B1
(45) Date of Patent: Mar. 29, 2011

(54) TURBINE ROTOR BLADE WITH SPIRAL AND SERPENTINE FLOW COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1099 days.

(21) Appl. No.: 11/654,159

(22) Filed: Jan. 17, 2007

(51) Int. Cl.
*F01D 5/18* (2006.01)

(52) U.S. Cl. ..... 416/1; 416/97 R

(58) Field of Classification Search ..... 415/115; 416/90 R, 96 R, 97 R
See application file for complete search history.

(56) References Cited

U.S. PATENT DOCUMENTS

| | | | | |
|---|---|---|---|---|
| 2,920,865 | A | 1/1960 | Lombard | |
| 4,407,632 | A * | 10/1983 | Liang | 416/97 R |
| 4,753,575 | A | 6/1988 | Levengood et al. | |
| 4,767,268 | A | 8/1988 | Auxier et al. | |
| 5,350,277 | A | 9/1994 | Jacala et al. | |
| 5,538,394 | A * | 7/1996 | Inomata et al. | 416/97 R |
| 5,591,007 | A | 1/1997 | Lee et al. | |
| 5,902,093 | A | 5/1999 | Liotta et al. | |
| 5,941,687 | A | 8/1999 | Tubbs | |
| 5,967,752 | A | 10/1999 | Lee et al. | |
| 5,975,851 | A | 11/1999 | Liang | |
| 6,139,269 | A | 10/2000 | Liang | |
| 6,186,741 | B1 | 2/2001 | Webb et al. | |
| 6,264,428 | B1 | 7/2001 | Dailey et al. | |
| 6,331,098 | B1 | 12/2001 | Lee | |
| 6,554,575 | B2 | 4/2003 | Leeke et al. | |
| 6,565,312 | B1 | 5/2003 | Horn et al. | |
| 6,966,756 | B2 | 11/2005 | McGrath et al. | |
| 7,008,179 | B2 | 3/2006 | Rinck et al. | |
| 7,094,031 | B2 | 8/2006 | Lee et al. | |
| 7,097,426 | B2 | 8/2006 | Lee et al. | |
| 7,293,961 | B2 * | 11/2007 | Lee et al. | 416/96 R |

* cited by examiner

*Primary Examiner* — Edward Look
*Assistant Examiner* — Ryan H Ellis
(74) *Attorney, Agent, or Firm* — John Ryznic

(57) ABSTRACT

A turbine rotor blade for a gas turbine engine that includes a five-pass spiral serpentine flow cooling circuit with a first channel extending along the pressure side of the blade, a second channel extending along the suction side of the blade and connected to the first channel at the airfoil tip, a third channel extending along the pressure side and connected to the second channel in the root portion, and fourth channel extending along the suction side and connected to the third channel at the blade tip, and a fifth channel extending along the trailing edge and discharging cooling air through exit holes. The first and second channels are opposite to each other and have the same chordwise length, and the third and fourth channels are opposite to each other and have the same chordwise length to form a spiral flow path between the second and third channels and between the fourth and fifth channels. All five channels are connected in series to form the serpentine flow path. A leading edge supply channel provides for cooling air to a showerhead arrangement, and the leading edge channel is connected to the first channel at the blade tip. Pin fins and trip strips enhance the heat transfer coefficient from the blade to the cooling air throughout the channels.

21 Claims, 4 Drawing Sheets

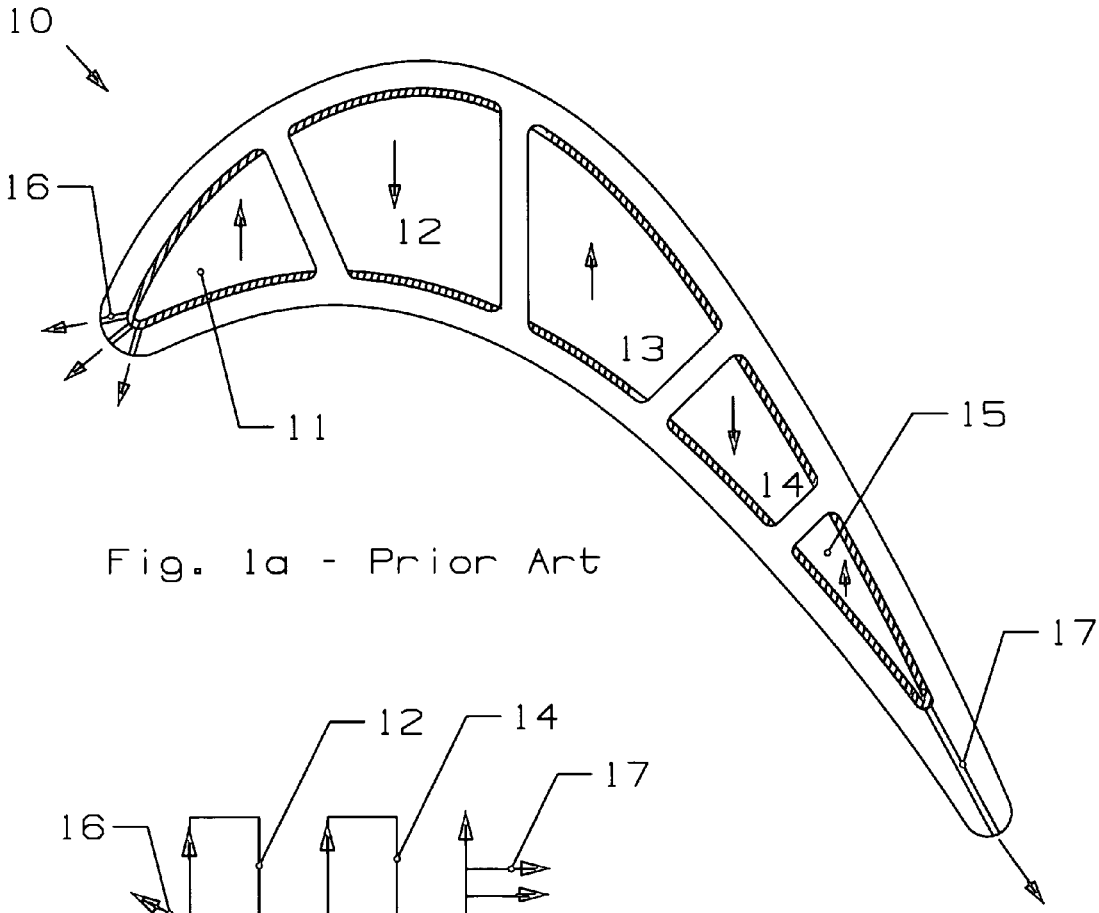
Fig. 1a - Prior Art
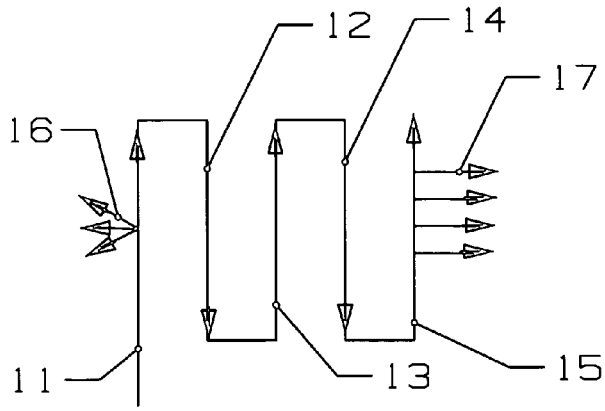
Fig. 1b - Prior Art

TURBINE ROTOR BLADE WITH SPIRAL AND SERPENTINE FLOW COOLING CIRCUIT

BACKGROUND OF THE INVENTION

1. Field of the Invention

The present invention relates generally to fluid reaction surfaces, and more specifically to a turbine rotor blade with a serpentine flow cooling circuit.

2. Description of the Related Art Including Information Disclosed Under 37 CFR 1.97 and 1.98

Turbine airfoils, such as rotor blades and stator vanes, pass cooling air through complex cooling circuits within the airfoil to provide cooling from the extreme heat loads on the airfoil. A gas turbine engine passes a high temperature gas flow through the turbine to produce power. The engine efficiency can be increased by increasing the temperature of the gas flow entering the turbine. Therefore, an increase in the airfoil cooling can result in an increase in engine efficiency.

Prior art airfoil cooling of blades makes use of a single five-pass aft flowing serpentine cooling circuit. One such prior art 5-pass serpentine flow circuit for an airfoil 10 is shown in FIGS. 1*a* and 1*b* and includes a first up-pass channel 11 of the 5-pass serpentine flow circuit near the airfoil leading edge. A showerhead arrangement of film cooling holes 16 is included in the first up-pass channel 11 of the serpentine flow cooling channel to provide film cooling for the high heat load section of the airfoil nose. The cooling air flows into a first down-pass channel 12 downstream from and adjacent to the first up-pass channel 11, and then into a second up-pass channel 13 and a second down-pass channel 14 before entering a trailing edge up-pass channel 15 where the cooling air is finally discharged through a row of trailing edge cooling holes 17. The five channels 11-15 that form the 5-pass serpentine flow cooling circuit of FIG. 1 each extend from the pressure side wall to the suction side wall such that each channel provides near wall cooling for both sides of the airfoil (the pressure side and the suction side).

In the prior art 5-pass aft flowing serpentine cooling circuit of FIG. 1, the internal cavities are constructed with internal ribs connecting the airfoil pressure and suction walls. In most of the cases, the internal cooling cavities are at low aspect ratio which is subject to high rotational affect on the cooling side heat transfer coefficient. In addition, the low aspect ratio cavity yields a very low internal cooling side convective area ratio to the airfoil hot gas external surface.

The object of the present invention is to provide for a blade with a cooling circuit that provides for a near wall spiral flow cooling arrangement which optimizes the airfoil mass average sectional metal temperature to improve airfoil creep capability for a blade cooling design.

Another object of the present invention is to maximize the airfoil cooling performance for a given amount of cooling air and minimize the Coriolis effects due to rotation on the airfoil internal cavities heat transfer performance.

BRIEF SUMMARY OF THE INVENTION

A turbine rotor blade having an internal cooling circuit forming a 5-pass serpentine flow circuit in which the serpentine channels also form a spiral flow circuit. The spiral serpentine flow circuit includes a first up-pass channel on the pressure side of the airfoil and a first down-pass channel adjacent to the first up-pass channel but on the suction side of the airfoil. A second up-pass channel is located adjacent to the first up-pass channel and on the pressure side of the airfoil. A second down-pass channel is located adjacent to the second up-pass channel but on the suction side of the airfoil. The last leg of the circuit is a trailing edge channel forming a third up-pass channel and includes a plurality of trailing edge cooling exit holes. The blade also includes a leading edge up-pass channel adjacent to the first up-pass channel and first down-pass channel and is connected to the first up-pass channel at the blade tip region. The leading edge up-pass channel includes a showerhead arrangement to provide film cooling for the leading edge of the blade. Each channel in the 5-pass serpentine circuit includes a plurality of pin fins extending across the channel to provide structural rigidity to the blade and to promote turbulent flow in the cooling air.

BRIEF DESCRIPTION OF THE SEVERAL VIEWS OF THE DRAWINGS

FIG. 1*a* shows a prior art 5-pass serpentine flow cooling circuit.

FIG. 1*b* shows a diagram view of the prior art 5-pass serpentine flow circuit of FIG. 1*a*.

DETAILED DESCRIPTION OF THE INVENTION

Figure 2:
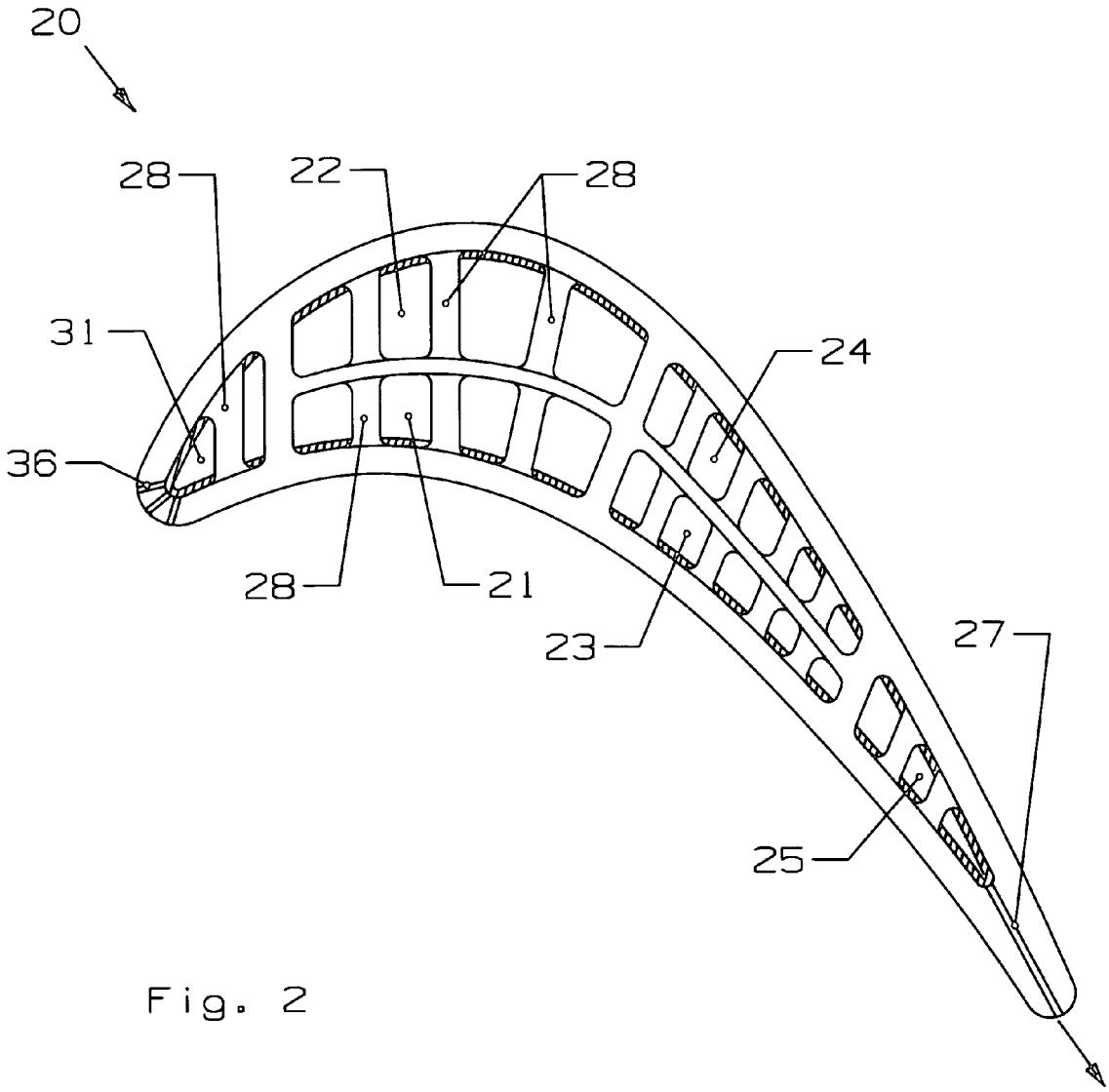
FIG. 2 shows a top view of the 5-pass serpentine flow cooling circuit of the present invention.
Figure 3:
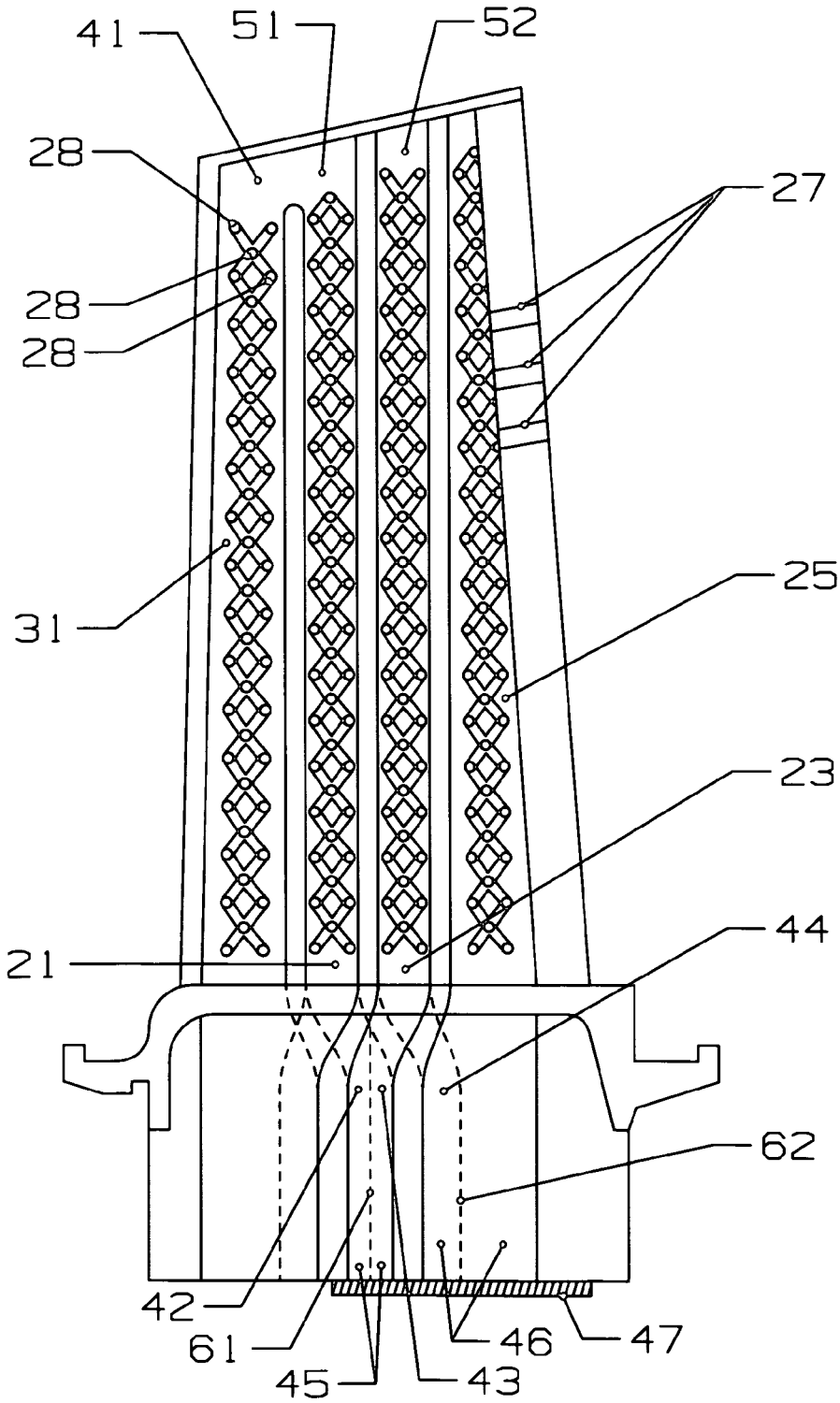
FIG. 3 shows a side view of the pressure side of the blade with the 5-pass serpentine flow circuit of the present invention.
Figure 4:
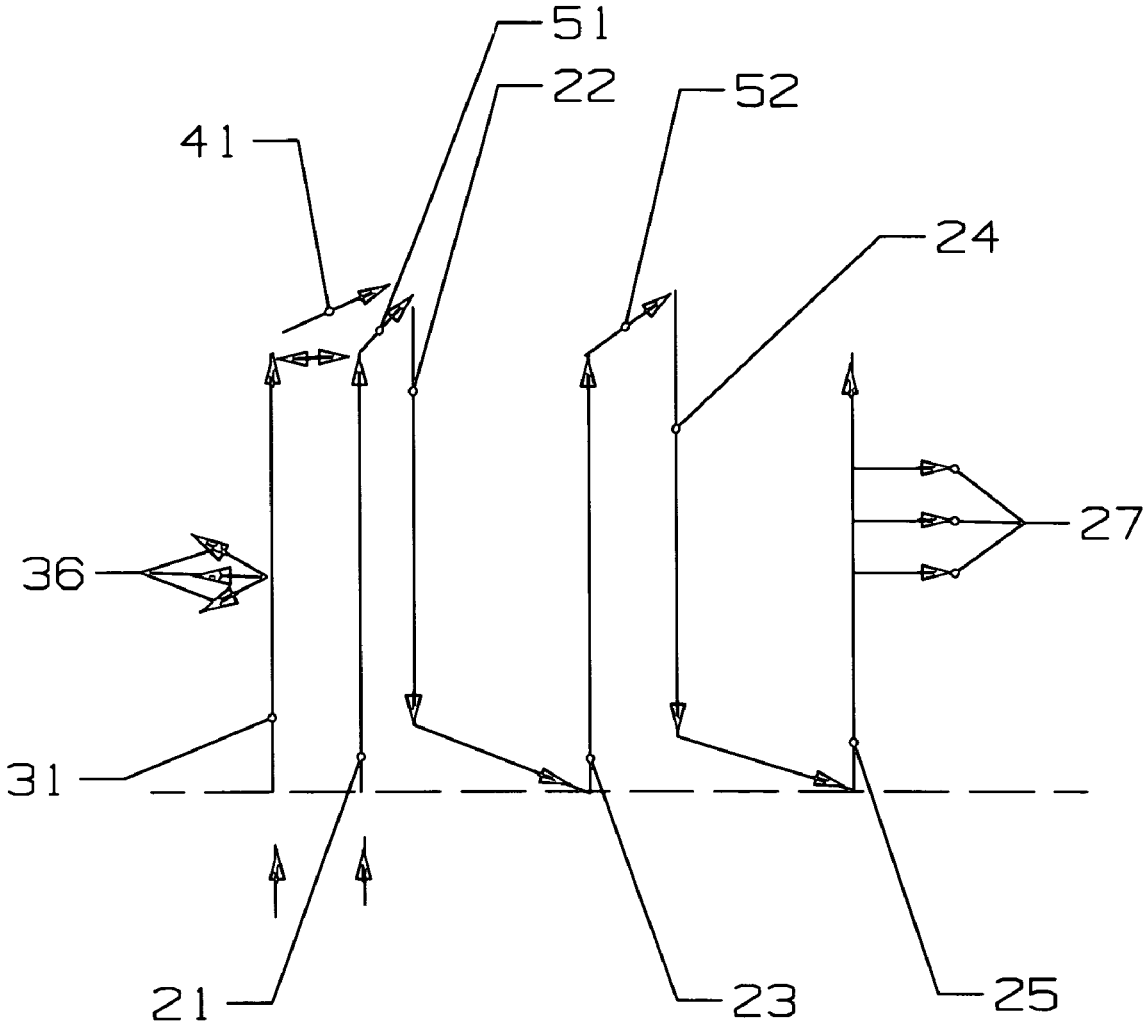
FIG. 4 shows a schematic diagram of the cooling air flow for the spiral serpentine flow cooling circuit of the present invention.

The present invention is a turbine rotor blade with a serpentine flow cooling circuit to provide internal cooling of the airfoil. The blade 20 is shown in FIGS. 2 and 3 with a 5-pass serpentine flow circuit. The blade 20 includes a leading edge with a leading edge cooling supply channel 31 is located in the leading edge region of the blade 20 and is connected to the cooling air supply passage in the blade root to deliver cooling air to the channel 31 and through the showerhead film cooling holes 36 arranged around the leading edge of the blade 20. The 5-pass serpentine flow cooling circuit of the present invention includes a first pressure side up-pass channel 21 located on the pressure side of the blade. A first suction side down-pass channel 22 is located on the suction side of the blade and opposite from the first pressure side up-pass channel 21. The two channels 21 and 22 have substantially the same chord-wise length. A second pressure side up-pass channel 23 is located on the pressure side of the blade 20. A second suction side down-pass channel 24 is located on the suction side and opposite from the second pressure side up-pass channel 23. The two channels 23 and 24 have substantially the same chord-wise length. A trailing edge up-pass channel 25 is located in the trailing edge region of the blade 20 and extends from the pressure side to the suction side of the blade. A plurality of cooling exit holes 27 extend along the trailing edge of the blade and connect the trailing edge channel 25 to the outside of the blade.

FIG. 3 shows a side view of a cross section through the blade in the pressure side section. The leading edge supply channel 31 is located on the left-most side of FIG. 3 and includes a row of pin fins 28 that extend from the pressure side to the suction side of the blade FIG. 2 shows one row of pin fins 28 while FIG. 3 shows three rows that form an X pattern with trip strips connecting adjacent pin fins 28. The number of rows of pin fins will vary and depend upon the size of the channel. The pin fins 28 provide structural rigidity to the blade and form turbulence promoters for the cooling air flow. These factors will determine how many rows of pin fins are used in the channel. The first pressure side up-pass channel 21 is shown adjacent to the leading edge supply channel 31 with three rows of pin fins 28 extending across the channel with trip strips connecting adjacent pin fins 28. The leading edge channel 31 and the two channels 21 and 22 are connected at the blade tip by a tip discharge chamber 41.

Located behind the first pressure side up-pass channel 21 is the first suction side down-pass channel 22 that is not shown in FIG. 3. Channel 21 is connected to channel 22 at the blade tip by a first tip turn 51 which is formed from the tip discharge chamber 41 that connects all three channels 31, 21, and 22. The first suction side down-pass channel 22 will flow downward (as shown in FIG. 3) and into a first root section collector cavity 45 formed within the blade root and enclosed by a cover plate 47. An end 42 of the first suction side down-pass channel opens into the first root section collector cavity 45 which then leads into the beginning 43 of the second pressure side up-pass channel 23 which flows upwards toward the blade tip. Behind the channel 23 in FIG. 3 is the second suction side down-pass channel 24 with an ending 44 in a second root section collector cavity 46 that is also formed within the root section and covered by the cover plate 47. Cooling air from the ending 44 of the second suction side down-pass channel 24 flows into the trailing edge flow channel 25 in an upward direction of FIG. 3 toward the blade tip. The second pressure side up-pass channel 23 and the second suction side down-pass channel 24 are connected together at the blade tip region by a second tip turn 52. The trailing edge channel 25 in connected to a plurality of cooling air exit holes 27 extending along the trailing edge from the platform to the tip of the blade 20.

In operation, cooling air is fed into the 5-pass aft flowing spiral flow circuit on the leading edge cavity 31 and the first pressure side of the up-pass cooling channel 21. the cooling air is then discharged in the first blade tip turn chamber 51 and downward through the airfoil first suction side serpentine cooling channel 22 and discharged into the first blade root section collection cavity 45. This cooling air then flows upward from the second pressure side serpentine cooling channel 23 and across the second blade tip turn 52 and downward through the airfoil second serpentine suction side cooling channel 24 to be discharged into the second blade root section collection cavity 46. The cooling air then flows upward from the second cooling collection cavity 46 and through the airfoil trailing edge cooling channel 25 for cooling of the trailing edge region and distributes cooling for the airfoil trailing edge discharge cooling holes 27. Pin fins 28 extend across the channels to promote turbulent flow within the cooling air. Trip strips are used along the channel walls to also promote heat transfer from the hot wall to the cooling air.

The five-pass spiral serpentine flow cooling circuit of the present invention is cast into a blade by using five individual ceramic core dies that are interconnected together where adjacent channels have cooling air flowing from one channel to the other. A composite core technique is used to form the assemble core for the entire casting core. Ceramic cores for the leading edge channel 31 and first pressure side up-pass channel 21 are mated together at the blade root section and join together with the ceramic core for the first suction side down-pass channel 22 at the blade tip first tip turn region 51. The ceramic core for the first suction side down-pass channel 22 is mated with the ceramic core for the second pressure side up-pass channel 23 at the blade attachment region. The ceramic core for the second pressure side up-pass channel is then mated with the ceramic core for the second suction side down-pass channel. The ceramic core for the second suction side down-pass channel is finally mated with the ceramic core for the airfoil trailing edge channel 25 at the blade attachment region to complete the 5-pass spiral serpentine flow circuit. FIG. 3 shows the mate face 61 between the first suction side down-pass channel 22 and the second pressure side up-pass channel 23, and the mater face 62 between the second suction side down-pass channel 24 and the trailing edge channel 25 with both of these mate faces being in the root or blade attachment region. The mate face 61 and 62 is the faces of the adjacent ceramic cores that will form the cooling air passage between the adjacent channels when the blade has been cast and the ceramic cores have been leached away.

The spiral serpentine flow cooling circuit of the present invention minimizes the airfoil "rotational effects" for the cooling channel internal heat transfer coefficient. This achieves an improved airfoil internal cooling performance for a given cooling supply pressure and flow level over the cited prior art references. Pin fins and trip strips are also incorporated in the high aspect ratio near wall cooling channels to further enhance the internal cooling performance. A lower airfoil mass average sectional metal temperature and a higher stress rupture life are achieved.

I claim:

1. A turbine airfoil having a leading edge and a trailing edge, and a pressure side and a suction side forming the airfoil surface, the turbine airfoil comprising:

a five-pass spiral serpentine flow cooling circuit comprising a first pressure side up-pass channel extending along the pressure side of the airfoil;

a first suction side down-pass channel located on the suction side of the airfoil and in fluid communication with the first pressure side up-pass channel at the airfoil tip region;

a second pressure side up-pass channel located on the pressure side of the airfoil and in fluid communication with the first suction side down-pass channel at the airfoil root region, where the first pressure side up-pass channel and the first suction side down-pass channel and the second pressure side up-pass channel form both a spiral and serpentine flow between them;

a second suction side down-pass channel in fluid communication with the second pressure side up-pass channel at the airfoil tip region; and, a trailing edge cooling channel in fluid communication with the second suction side down-pass channel at the airfoil root region.

2. The turbine airfoil of claim 1, and further comprising:

a leading edge cooling channel in fluid communication with a plurality of film cooling holes forming a showerhead to provide cooling to the leading edge of the airfoil.

3. The turbine airfoil of claim 2, and further comprising:

the leading edge cooling channel is also in fluid communication with the first pressure side up-pass channel at the airfoil tip region.

4. The turbine airfoil of claim 3, and further comprising:

the leading edge channel is in fluid communication with the first pressure side up-pass channel and the first suction side down-pass channel through a tip section discharge chamber such that cooling air can flow between the leading edge channel and the first pressure side up-pass channel and from these two channels into the first suction side down-pass channel.

5. The turbine airfoil of claim 2, and further comprising:

the leading edge channel and the first pressure side up-pass channel are both in fluid communication with an external source of cooling air.

6. The turbine airfoil of claim 1, and further comprising:

the first suction side down-pass channel and the second pressure side up-pass channel are fluidly connected together in a first root section collector cavity.

7. The turbine airfoil of claim 1, and further comprising:

the second suction side down-pass channel and the trailing edge channel are fluidly connected together in a second root section collector cavity.

8. The turbine airfoil of claim 1, and further comprising:

the channels each comprise a plurality of pin fins extending across the channels to provide structural rigidity to the airfoil and promote turbulent flow within the cooling air flow.

9. The turbine airfoil of claim 1, and further comprising:

the trailing edge channel narrows in the flow direction from root to tip of the airfoil.

10. The turbine airfoil of claim 1, and further comprising:

the first pressure side up-pass channel and the first suction side down-pass channel both have substantially the same airfoil chord-wise length.

11. The turbine airfoil of claim 1, and further comprising:

the second pressure side up-pass channel and the second suction side down-pass channel both have substantially the same airfoil chord-wise length.

12. A process for cooling a turbine airfoil used in a gas turbine engine, the airfoil including an internal serpentine flow cooling circuit, the process comprising the steps of:

passing cooling air up a first channel located along the pressure side of the airfoil;

passing the cooling air from the first channel over a tip region and into a second channel extending along the suction side of the airfoil;

passing the cooling air from the second channel through the root portion of the airfoil and into a third channel extending along the pressure side of the airfoil;

passing the cooling air from the third channel through the tip portion of the airfoil and into a fourth channel extending along the suction side of the airfoil; and, passing the cooling air from the fourth channel through the root portion of the airfoil and into a trailing edge channel.

13. The process for cooling a turbine airfoil of claim 12, and further comprising the step of:

discharging cooling air from the trailing edge channel through a plurality of exit holes.

14. The process for cooling a turbine airfoil of claim 12, and further comprising the step of:

passing cooling air into a leading edge supply channel and into a showerhead arrangement to provide cooling for the leading edge of the airfoil.

15. The process for cooling a turbine airfoil of claim 14, and further comprising the step of:

joining the cooling air flows of the first channel and the leading edge channel near the tip of the airfoil.

16. The process for cooling a turbine airfoil of claim 12, and further comprising the step of:

passing the cooling air through the five serpentine flow channels without discharging cooling air through film cooling holes.

17. The process for cooling a turbine airfoil of claim 12, and further comprising the step of:

enhancing heat transfer coefficient to the cooling air with the use of pin fins and trip strips in at least some of the channels.

18. A turbine rotor blade comprising:

a pressure side wall and a suction side wall extending between a leading edge region and a trailing edge region;

a five-pass serpentine flow cooling circuit extending from adjacent to the leading edge region to the trailing edge region;

the five-pass serpentine flow cooling circuit including a first leg and a third leg positioned along the pressure side wall and both being radial upward flowing channels;

the five-pass serpentine flow cooling circuit including a second leg and a fourth leg positioned along the suction side wall and both being radial downward flowing channels; and, a fifth leg located adjacent to the trailing edge region and extending across the pressure wall side to the suction wall side.

19. The turbine rotor blade of claim 18, and further comprising:

the five legs of the five-pass serpentine flow cooling circuit each include pin fins extending across the channel and trip strips.

20. The turbine rotor blade of claim 18, and further comprising:

a row of exit holes in the trailing edge region connected to the fifth leg of the five-pass serpentine flow cooling circuit.

21. The turbine rotor blade of claim 18, and further comprising:

a leading edge cooling channel in fluid communication with a plurality of film cooling holes forming a showerhead to provide cooling to the leading edge of the airfoil; and, the leading edge cooling channel is also in fluid communication with the first leg of the five-pass serpentine flow cooling circuit.

* * * * *